US005380451A

United States Patent [19]

Rieger

[11] Patent Number: 5,380,451

[45] Date of Patent: Jan. 10, 1995

[54] BATH FOR THE PRE-TREATMENT OF LIGHT METALS

[76] Inventor: Franz Rieger, Riedstrasse 1, 7924 Steinheim am Albuch, Germany

[21] Appl. No.: 25,026

[22] Filed: Mar. 2, 1993

[30] Foreign Application Priority Data

Sep. 17, 1992 [DE] Germany ..... 4231052
Nov. 12, 1992 [DE] Germany ..... 4238242

[51] Int. Cl.[6] ..... B44C 1/22; C23F 1/00; C09K 13/04

[52] U.S. Cl. ..... 252/79.2; 156/637; 156/664; 156/665; 427/309

[58] Field of Search ..... 252/79.2, 79.4, 142; 427/304, 309; 156/637, 639, 664, 665; 134/3, 34, 41

[56] References Cited

U.S. PATENT DOCUMENTS

| | | | |
|---|---|---|---|
| 1,832,979 | 6/1929 | George | 134/3 X |
| 2,834,659 | 5/1958 | Mathe et al. | 252/79.2 X |
| 3,663,327 | 5/1971 | Ritzi | 252/79.2 X |
| 5,227,016 | 7/1993 | Carlson et al. | 156/665 |

*Primary Examiner*—William Powell

[57] ABSTRACT

A bath for pre-treatment of light metals that form oxide layers, before electroless (chemical) metal deposition is an aqueous bath containing phosphorous acid. The bath is used in the following process for electroless deposition of nickel: (1) Degreasing by boiling (2) Rinsing (3) Pickling (4) Rinsing (5) Treatment in aqueous bath containing phosphoric acid (6) Rinsing with water (7) Chemically nickel plating (8) Rinsing. The light metal articles are packed in a drum that is immersed and rotated in the pre-treatment bath. Current and voltage are applied to a light metal bar that is attached to a non-rotating place on the drum.

14 Claims, 1 Drawing Sheet

BATH FOR THE PRE-TREATMENT OF LIGHT METALS

This invention relates to a bath for pre-treatment of light metals that form oxides prior to electroless metal deposition on such metals, to a process using such bath and the articles produced thereby.

BACKGROUND OF THE INVENTION

A Licer bath for the pre-treatment of light metals is known from German Patent 3,246,323, column 2, lines 43–45. The word "Licer" originates from electroplating technical language; namely, the French "lisser" meaning "to smooth, to polish."The bath is used in the German patent for the pre-treatment of articles of aluminum and aluminum alloys, before directly electroplating with nickel. Nickel layers are also deposited in the case of the present invention with the values given in the German patent (see column 3, paragraph 1), nickel anodes being used as the anodes.

In electroplating the possibility exists per se of immersing articles suspended on frames into the bath, or putting the articles into bulk materials containers such as vibrators or drums, then lowering the latter into the bath and then treating the materials. During this process at least the casing of the drum is rotated and the bulk materials then tumble and fall over one another, the operations taking place statistically. In another process, the materials are vibrated with and in a basket, and the parts then tumble over one another statistically.

The drum is used with considerable reservations, because a statistical process is involved in which the geometry of the electrical fields and the inflow and outflow behavior of the liquids, etc., are understood only statistically. For example, there arise in the pre-treatment bath only statistically distributed point contacts when the bulk materials tumble and fall over one another. The same holds true for the vibration process.

Apart from metal deposition by electroplating with an externally supplied current, there is also electroless (chemical) metal deposition without external current. Although the desired aim of both technologies is the same, namely to deposit metal, the technologies are very different. Baths for the chemical deposition of nickel, copper, gold and the like are produced by Schlotter, Biasberg, M+T, and other companies.

SUMMARY OF THE INVENTION

The invention has a number of objectives. One objective is to provide a bath and a process in which the chemical deposition steps are substantially fewer than in the prior art. Other objectives are to provide a process in which there is less "drag-out;" less environmental pollution is produced, because the keeping time of the bath is high; to provide a process with high reproducibility, that has a high "throwing power," and is economical and simple to use. The invention provides an advantageous process for bulk materials. Further, the object of the invention is to produce light metal articles that use the bath and the process.

According to the invention, these objectives are achieved by treating light metals that form oxides in an aqueous bath containing phosphoric acid prior to electroless chemical metal deposition. The bath and the pre-treatment process are made advantageous for bulk materials by placing the articles in a bulk materials container and immersing the bulk materials container in the pre-treatment bath. Conveniently, the bulk materials container is a rotatable drum or a vibrating apparatus.

Advantageously, the bath may contain only phosphoric acid in water. Or the bath may contain phosphoric acid in water within the following ranges: 100–550 g/L; or 150–500 g/L; or 200–450 g/L; or 300 g/L±30%; or 300 g/L±20%; or 300 g/L±10%. The phosphoric acid is free from halogens.

The water of the aqueous bath may be tap water, distilled water, de-ionized water or completely desalted water. Light metals suitable for pre-treatment include aluminum, magnesium and titanium and their alloys.

It is surprising that the pre-treatment bath for electroless (chemical) deposition according to the invention is the same type used in electroplating deposition techniques, and performs with excellent results. The pre-treatment bath according to the invention makes electroless deposition possible not only for nickel, but may also be used for copper and at least gold, among the noble metals. The deposit of copper and gold is pure. The nickel deposit can be pure—according to the nickel bath—but will mainly be an alloy of up to 15% nickel and phosphorous. In addition to nickel and phosphorous, in many cases boron is also used. Dispersion layers can also be deposited by means of the invention. The dispersion layers may be NiP with SiC inclusions, and/or PTFE inclusions and/or BC inclusions and/or $Al_2O_3$ inclusions.

BRIEF DESCRIPTION OF THE DRAWING

The invention is described in the following preferred embodiments taken together with the drawing in which.

DETAILED DESCRIPTION OF PREFERRED EMBODIMENTS

Figure 1:
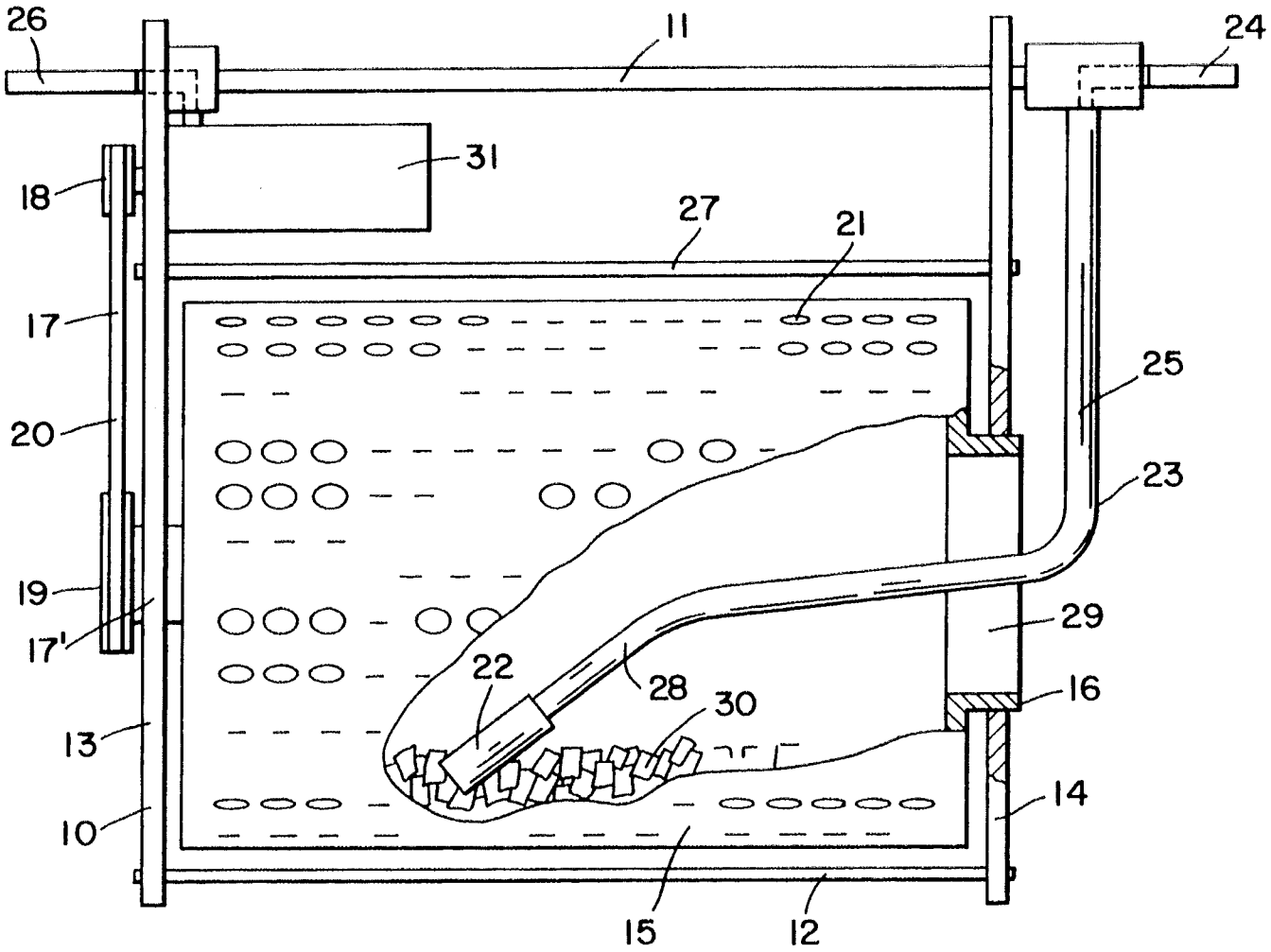
FIG. 1 is a side view of a bulk materials drum immersible in the bath according to the invention, partially broken away to show the light metal bar and bulk materials in the drum.

The following steps were necessary up to now for chemical deposition of nickel: (1) Degreasing by boiling (2) Rinsing (3) Pickling (4) Rinsing (5) Zincate pickling (6) Rinsing (7) Steps (3)–(6) repeated (8) Pre-nickeling (9) Chemical nickel plating (10) Rinsing. Instead of zincate pickling, stannate pickling or mixed metal pickling also has been used.

In a preferred embodiment employing a bath according to the invention, the steps for chemical deposition of nickel are as follows: (1) Degreasing by boiling (2)Rinsing (3) Pickling (4) Rinsing (5) Treatment in a bath according to the invention (6) Rinsing with water (7) Chemically nickel plating (8) Rinsing.

A pre-treatment layer in the lower micrometer range is deposited on the light metal. It can be thinner than 1 micrometer, or 0.5 micrometer, or can be a few atomic layers thick. The layer can be continuous or the layer can form islands. The pre-treatment layer is porous, and in one case has columnar channels that extend from the exterior towards the base material and often reach the base material. In another case, the layer exhibits cavities. Mixed forms of these two layers also exist.

Cyanide baths and cyanide free baths according to the prior art are very viscous. The bath liquid adheres to the articles like "tears" Consequently, there is a high "drag-out" rate of the liquid from the bath. According to the invention, it is possible to rinse with water and if necessary to add a detergent to the water, so that the drag-out rate is practically nil. Also, the gel produced by prior art cyanide baths continues to adhere to the article and react as the article is raised above the bath. According to the invention, when the article is lifted from the bath, the reaction is thereby ended.

The process is not suited for every chemical bath on the market. As has hitherto been necessary in the technology of such metal depositions, usable baths must be sought out, because they have different stabilizers. The invention works at least with the SLOTORIC Bath of the Schlotter Company.

In terms of the troughs in which the pre-treatment is carried out, the bath has practically no special requirements. Rubberized steel troughs, plastic troughs and special steel troughs can be used.

After the articles are treated in the bath, the articles may be introduced directly into an electroless chemical metal deposition bath or the articles may be stored for a period of time. If necessary, the articles may be rinsed solely with water, and then introduced into the chemical metal deposition bath.

Following pre-treatment according to the invention, the articles may be coated in a drum with the desired metal layer, e.g. nickel. The articles are then hung on frames and suspended in the electroless metal deposition bath, e.g. a nickel-plating bath. For bulk articles, metal deposition in the drum would per se be more economical.

Surprisingly, the drum process may also be used for pre-treatment. The articles are pre-treated in the aqueous bath containing phosphoric acid in a drum. Of course, for this purpose it is necessary to apply an electric voltage to the drum. The drum process may be used even though bulk bodies move randomly in the drum during pre-treatment and also during metal deposition. The bodies cannot be fixed in a pre-determined position in the baths, as is possible when they are hung on frames.

An immersible drum is shown in FIG. 1. The drum 15 is made of plastic and has holes 21 that enable the pre-treatment bath to contact bulk materials 30 in the drum 15. The drum is held rotatably in support cage 10 having a front bearing plate 14 and a rear bearing plate 13 held in spaced position by upper rod 27 and lower rod 12. The drum 15 is held rotatably at front bearing 16 in front bearing plate 14 and rear bearing 17' in rear bearing plate 13.

A rotational drive 17 has a lower pulley 19 and an upper pulley 18.

A v belt 20 is connected to pulleys 18 and 19. The rotational drive is driven by electric motor 20 connected to pulley 18. Electrode 26 is connected to electric motor 31 to power the motor and rotate the drum. The electrode 26 is supported by drum support rod 11 from which the drum 15 is suspended.

A light metal bar 22 is positioned to contact the bulk materials 30 in the drum 15 that are treated in the pre-treatment bath when the drum 15 is immersed completely or partially in the bath.

The light metal bar is attached to the downward-bending end portion 28 of a hollow isolation tube 23. A wire 20 in the isolation tube 23 carries voltage and current to the light metal bar 22 from electrode 24. The tube 23 passes through an opening 29 in the front bearing 16 and is supported by supporting rod 11, which does not rotate with drum 15.

Instead of a drum 15, a vibrator may be used to move the bulk materials in the pre-treatment bath. The vibrator configuration is similar to the drum configuration. Instead of a rotating drum 15, a basket containing the bulk materials 30 and a light metal bar is supported on vibrating elements. The light metal bar is attached to one end of an isolation tube that is supported at its other end by a support rod that also supports the vibrating basket. Current and voltage are applied to the light metal bar through a wire running inside the isolation tube.

The process employs the bulk materials drum 15 for the bath, with an applied voltage that slowly rises. In performing the process, the bulk materials 30 are packed into the bulk materials container (drum) 15. The drum 15 is lowered into the pre-treatment bath, which is allowed to permeate through the bulk materials 30, and current and voltage are applied to the drum through the light metal bar 22. This can be of aluminum or titanium. The drum 15 is immersed in the bath more than halfway to completely. The bulk materials container is substantially or completely made of plastic. The light metal bar 22 is provided in the lower region of the drum, has an electrical voltage applied to it, and does not rotate. The light metal bar 22 is attached to a non-rotating place (support rod 11) on the drum 15. The drum 15 requires between 2 and 15 seconds for a revolution. When the light metal bar 22 becomes too thickly coated with the deposition material of the counter-electrode (usually nickel), the bar is withdrawn again, and its surface is cleaned.

The applied voltage rises at the rate of 1 volt±20% per 10 seconds±20%. The voltage also may rise at the rate of 1 volt within the range ±40% per 10 seconds ±40%. The final voltage can be in the region up to about 90 volts, but preferably in a lower region: in the range of 5–25 volts; more particularly in the range of 10–20 volts. The final voltage is lower for pure light metal alloys than for highly alloyed light metal alloys.

Electroless (chemical) and electroplating processes share some common features, but the electroless deposition process has some important advantages. Electroless deposition, according to the invention, uses the same pre-treatment bath that is used in electroplating. Unlike the steps describing prior art chemical deposition, the steps for electroless deposition according to the invention are stream-lined. It is not necessary to repeat Steps 3–6 of the prior art. Even if this repetition is not counted in, there are only 8 steps, according to the invention.

Furthermore, not only is the process shortened, but the pre-treatment bath according to the invention leads to other important advantages over the electroplating and chemical bath processes of the prior art. It is not necessary to introduce the article to be coated into the chemical nickel-plating bath immediately after step (6), rinsing with water. Rather, it is possible to store the article for a month or so, rinse it again and then introduce it into the chemical nickel-plating bath. During storage, the region on which nickel is to be chemically deposited must not be brought into contact with skin grease or the like. Using the process according to the invention, it is not necessary to preserve the article in a protective gas or the like. This lends eased flexibility, in terms of timing, to the electroless deposition process. Since a bulk materials drum is used both in the pre-treatment bath and the nickel-plating bath, it is possible to pre-treat and then deposit nickel in bulk using the drum process.

Positive attributes of electroless deposition are not limited to process improvements. Excellent end processing results are obtained, even when a bulk materials drum is used both in the pre-treatment bath and in the nickel-plating bath. The process is so efficient that, in spite of the bulk treatment of materials (using drums) for both the pre-treatment bath and the nickel-plating bath, the quality of the metal deposition is excellent in terms of thickness, uniformity and adhesiveness.

I claim:

1. Bath for the pre-treatment of light metals that form oxide layers, prior to electroless metal deposition on said light metals, comprising an aqueous bath containing phosphoric acid.

2. Bath according to claim 1, wherein said bath contains only phosphoric acid in water.

3. Bath according to claim 1, wherein said bath contains 100–550 g/L phosphoric acid in water.

4. Bath according to claim 3, wherein said bath contains 150–500 g/L of phosphoric acid.

5. Bath according to claim 4, wherein said bath contains 200–450 g/L of phosphoric acid.

6. Bath according to claim 4, wherein said bath contains 300 g/L±30% of phosphoric acid.

7. Bath according to claim 6, wherein said bath contains 300 g/L±20% of phosphoric acid.

8. Bath according to claim 6, wherein said bath contains 300 g/L±10% of phosphoric acid.

9. Bath according to claim 1, wherein said bath is the same as baths used for deposition of metal using external current.

10. Bath according to claim 1, wherein the water of said bath is tap water.

11. Bath according to claim 1, wherein the water of said bath is distilled water.

12. Bath according to claim 1, wherein the water of said bath is deionized water.

13. Bath according to claim 1, wherein the water of said bath is completely de-salted water.

14. Bath according to claim 1, wherein said phosphoric acid is free from halogens.

* * * * *